US012221963B2

(12) United States Patent
Batdorff et al.

(10) Patent No.: US 12,221,963 B2
(45) Date of Patent: Feb. 11, 2025

(54) COMPACT VARIABLE VOLUME INDEX VALVE FOR SCREW COMPRESSOR BACKGROUND

(71) Applicant: Hitachi Global Air Power US, LLC, Michigan City, IN (US)

(72) Inventors: Jonathan D. Batdorff, Fort Wayne, IN (US); Hideki Fujimoto, Shizuoka (JP); Christian Vaughn, La Porte, IN (US)

(73) Assignee: Hitachi Global Air Power US, LLC, Michigan City, IN (US)

( * ) Notice: Subject to any disclaimer, the term of this patent is extended or adjusted under 35 U.S.C. 154(b) by 0 days.

(21) Appl. No.: 18/685,493

(22) PCT Filed: Sep. 10, 2021

(86) PCT No.: PCT/US2021/049919

§ 371 (c)(1),
(2) Date: Feb. 21, 2024

(87) PCT Pub. No.: WO2023/038633

PCT Pub. Date: Mar. 16, 2023

(65) Prior Publication Data

US 2024/0352935 A1 Oct. 24, 2024

(51) Int. Cl.

| | |
|---|---|
| ***F04C 28/12*** | (2006.01) |
| ***F04C 18/16*** | (2006.01) |
| ***F04C 28/16*** | (2006.01) |

(52) U.S. Cl.

CPC ..... *F04C 28/12* (2013.01); *F04C 18/16* (2013.01); *F04C 28/16* (2013.01)

(58) Field of Classification Search

CPC ..... F04C 28/12; F04C 18/16; F04C 28/16
See application file for complete search history.

(56) References Cited

U.S. PATENT DOCUMENTS

| | | | | |
|---|---|---|---|---|
| 5,108,269 | A * | 4/1992 | Glanvall | F04C 28/16 417/310 |
| 5,556,271 | A * | 9/1996 | Zuercher | F04C 28/16 251/63 |
| 2016/0265533 | A1* | 9/2016 | Pullins | F04C 18/16 |
| 2021/0095675 | A1* | 4/2021 | Doden | F04C 18/16 |

OTHER PUBLICATIONS

International Search Report and Written Opinion dated Dec. 20, 2021, in International Application No. PCT/US2021/049919.

* cited by examiner

*Primary Examiner* — Mary A Davis
(74) *Attorney, Agent, or Firm* — Procopio, Cory, Hargreaves & Savitch LLP

(57) ABSTRACT

A screw compressor and a compact variable volume index valve therefore are provided. The compact variable volume index valve includes a linear valve member positioned adjacent a compression chamber outlet end of a compression chamber of the screw compressor, an actuator structure coupled to the liner valve member and oriented to move the linear valve member radially along the compression: chamber outlet end of the compression chamber to adjust a radial location where gas exits the compression chamber, wherein the actuator structure is coupled to a shutter of a spiral valve of the screw compressor such that the actuator structure moves the liner valve based on a position of the spiral valve of the screw compressor.

10 Claims, 11 Drawing Sheets

COMPACT VARIABLE VOLUME INDEX VALVE FOR SCREW COMPRESSOR

BACKGROUND

FIELD

The present disclosure relates to screw compressor and in particular a screw compressor having a control mechanism capable of varying a compressor volume index.

RELATED ART

Screw gas compressors may be known in the related art. In the related art, a screw compressor may include a compressor housing and a motor (for example, a permanent magnet rotor/stator motor) is used to drive one (e.g., a first compression screw) of the two compression screws. The second of the two compression screws may be mechanically coupled to the compression screw that is driven by the motor. The second compression screw may thus be driven by the first compression screw. In the related art, gas may be drawn into the compressor through an inlet, compressed between the two compression screws as they turn, and output through an outlet which is downstream of the gas inlet and the compression screws.

In some related art, the gas compressor may include a mechanical capacity control mechanism that provides one or more bypass ports or valve openings formed in the compressor housing or a rotor cowling to allow gas to exit the housing to control or prevent over pressurization or compression along the length of the compression screws. In the related art, the one or more bypass ports or valve openings may be positioned adjacent to a spiral valve that controls the opening and closing of the bypass ports or valve openings by a shutter that is rotated to a point that uncovers bypass ports and allows one or more of the bypass ports to communicate with the bypass chamber changing the compression length of the compressor.

However, in some related art, the adiabatic efficiency of a screw compressor equipped with a mechanical capacity control mechanism may be reduced by the amount of power used to recompress gas that has flowed back from the system being supplied to the compressor (under-compression). Moreover, as the compressor capacity is reduced by the variable capacity mechanism, the specific power (power/volume unit) increases.

In the related art, the specific power may be reduced if the compressor Vi (Volume index) were corrected to the value appropriate for the effective length determined by the capacity control mechanism. However, related art variable Vi mechanisms are expensive, significantly increase the compressor envelop, and require complex control systems.

Further, in the related art compressor manufacturers sometimes allow their compressors to be used to produce gas pressures other than that for which the Vi is optimized but doing this also causes a reduction in adiabatic efficiency. Thus, related art systems may either increase cost or decrease functionality.

SUMMARY

Aspects of the present disclosure may include a compact variable volume index valve for a screw compressor. The compact variable volume index valve may includes a linear valve member positioned adjacent a compression chamber outlet end of a compression chamber of the screw compressor, an actuator structure coupled to the liner valve member and oriented to move the linear valve member radially along the compression chamber outlet end of the compression chamber to adjust a radial location where gas exits the compression chamber, wherein the actuator structure is coupled to a shutter of a spiral valve of the screw compressor such that the actuator structure moves the linear valve based on a position of the spiral valve of the screw compressor.

Further aspects of present disclosure may include a screw compressor having a compressor housing defining a compression chamber having a compression chamber outlet end and a plurality of bypass ports communicating with the compression chamber, a spiral valve positioned adjacent the plurality of bypass ports communicating with the compression chamber, the spiral valve comprising a shutter configured to selectively open and close one or more of the plurality of bypass ports based on a rotational position, and a compact variable volume index valve. The compact variable volume index valve may include a linear valve member positioned adjacent a compression chamber outlet end of the compression chamber, an actuator structure coupled to the liner valve member and oriented to move the linear valve member radially along the compression chamber outlet end of the compression chamber to adjust a radial location where gas exits the compression chamber, wherein the actuator structure is coupled to the shutter of a spiral valve of the screw compressor such that the actuator structure moves the liner valve based on a position of the spiral valve of the screw compressor.

Additional aspects of the present disclosure may include the actuator structure having a toothed region provided on the linear valve member, and a toothed gear engaging the toothed region of the linear valve member, wherein the toothed gear is coupled to a shaft extending from the shutter of the spiral valve.

Additional aspects of the present disclosure may include the linear valve member having a semi-cylindrical shape.

Additional aspects of the present disclosure may include the linear valve member being inserted into a radial bore formed in the compressor housing.

Additional aspects of the present disclosure may include the linear valve member being inserted into the radial bore such that the valve member is offset toward the compression chamber outlet end from a centerline of the bore.

BRIEF DESCRIPTION OF THE DRAWINGS

A general architecture that implements the various features of the disclosure will now be described with reference to the drawings. The drawings and the associated descriptions are provided to illustrate example implementations of the disclosure and not to limit the scope of the disclosure. Throughout the drawings, reference numbers are reused to indicate correspondence between referenced elements.

DETAILED DESCRIPTION

Figure 1:
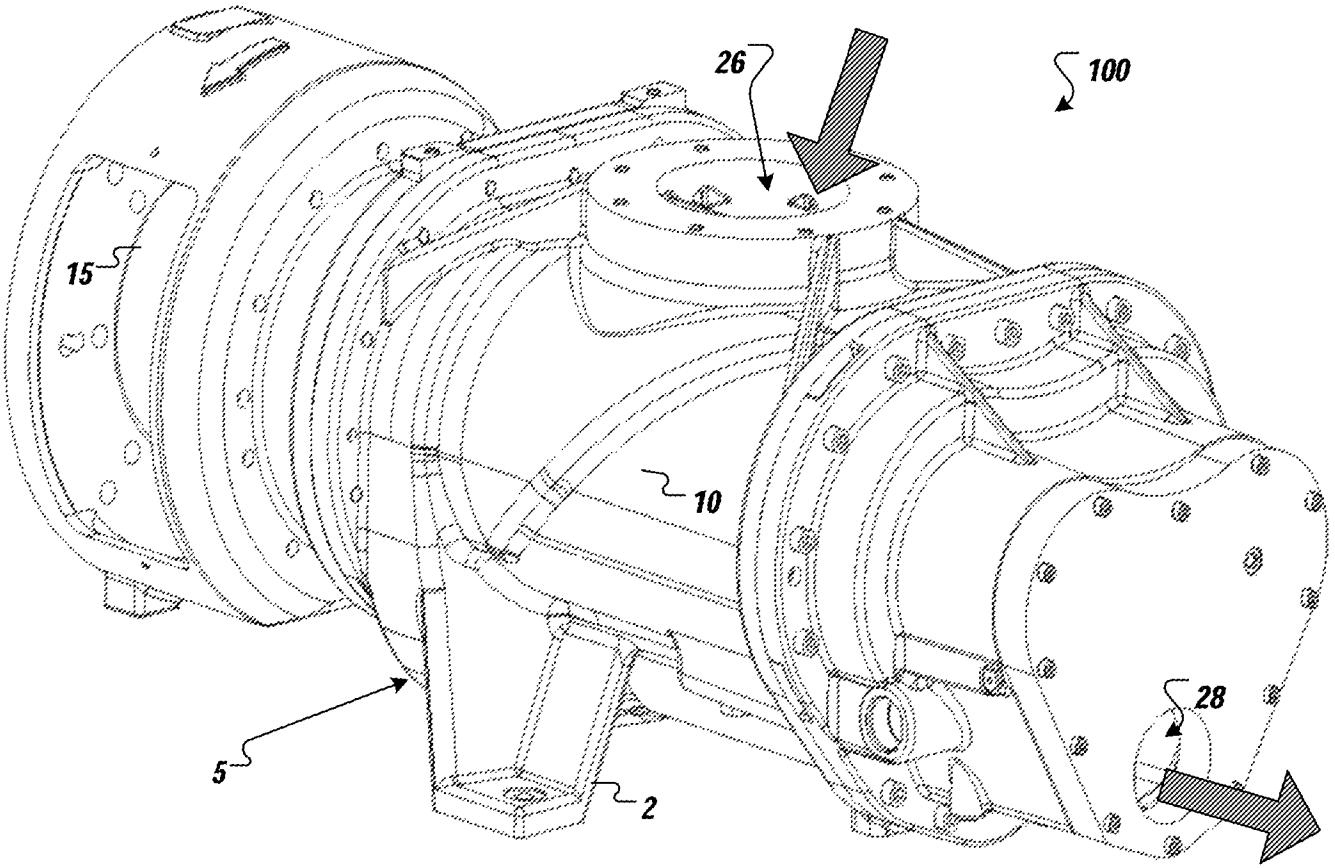
FIG. 1 illustrates a perspective view of a screw compressor in accordance with example implementations of the present disclosure.

The following detailed description provides further details of the figures and example implementations of the present disclosure. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or operator control over certain aspects of the implementation, depending on the desired implementation of one of ordinary skill in the art practicing implementations of the present disclosure. Further, sequential terminology, such as "first", "second", "third", etc., may be used in the description and claims simply for labeling purposes and should not be limited to referring to described actions or items occurring in the described sequence. Actions or items may be ordered into a different sequence or may be performed in parallel or dynamically, without departing from the scope of the present disclosure.

As explained above, in some related art, the adiabatic efficiency of a screw compressor equipped with a mechanical capacity control mechanism can be reduced by the amount of power needed to recompress gas that has flowed back from the system being supplied to the compressor. Further, as the compressor capacity is reduced by the variable capacity mechanism, the specific power increases. To attempt to address this, related art systems may use a mechanism to adjust the compressor volume index (Vi) based on the effective length of the compressor determined by the capacity control mechanism. However, related art variable Vi control mechanisms are expensive, significantly increase the compressor envelop, and require complex control systems.

To address these problems, example implementations of the present disclosure may include a CVVV (Compact Variable Vi Valve) that can decrease the size of the discharge port by raising the bottom edge of the discharge port (which determines Vi) so that the Vi can be optimized for the capacity produced at the maximum capacity reduction determined by the mechanical capacity control system. In some example implementations, the CVVV may include a radial slide valve incorporated into the rotor housing discharge face so that when it is moved down it effectively drops the bottom edge of the port and thereby increases the discharge port size and optimizes the Vi for the new higher capacity determined by the mechanical capacity control system.

As explained in this disclosure, the CVVV may be configured so that it can be applied to one side of the discharge port or both sides and can be actuated with a rack gear that is in contact with a pinion on a currently existing spiral valve mechanism or could be actuated using an electric stepper motor, linear motor, air cylinder, hydraulic cylinder or similar device. In some example implementations, using a single valve may provide a cost benefit while two valves may provide better performance. Because the valve opens and closes radially from the discharge port it utilizes space normally not used due to that area being used as the usual path for the discharge gas.

The variable nature of the CVVV also allows it to be a cost-effective way of optimizing the Vi for production of gas at various pressures. For this use the CVVV would most likely not be actuated with the rack and pinion mechanism but by one of the various other methods listed above.

FIG. 1 illustrates a perspective view of a screw compressor 100 having a spiral valve structure in accordance with example implementations of the present application. Further, FIGS. 2-4 respectively illustrate side, end, and top views of the screw compressor 100 in accordance with example implementations of the present application. As illustrated, the screw compressor 100 includes a compressor housing 10 that surrounds the compressor inner structure and forms a compression chamber 3 (not shown in FIGS. 1-4, illustrated in FIGS. 5-8). The housing 10 may include one or more mounting brackets or feet 2 that support the screw compressor 100 and allow the screw compressor 100 to be secured to a floor or other support platform. For example, the feet 2 may allow the screw compressor 100 to be mounted on a portable support platform or trailer.

The housing 10 also defines a main gas flow inlet 26, and a main gas flow discharge outlet 28. Arrows are provided to illustrate gas flow through the screw compressor 100. Additionally, the compressor housing 10 may allow a drive shaft 15 to pass from the compressor inner structure (illustrated in FIGS. 5-8) to the area surrounding the compressor 100.

The drive shaft 15 may be used to mechanically couple the screw compressor 100 to a motor or engine to drive the screw compressor 100. The screw compressor 100 may be driven by an IC Engine, such as a gasoline engine, a diesel engine, or any other type of engine that might be apparent to a person of ordinary skill in the art. The screw compressor 100 may also be driven by an electric motor, or any type of machine that supplies rotary motive power that might be apparent to a person of ordinary skill in the art.

Further, an actuator module 5 may be attached to the compressor housing 10 and control a spiral valve structure (shown in FIGS. 5-8) located within the compressor housing 10. As described below, the actuator module 5 may include an electric motor coupled to a gearbox that is coupled to the spiral valve. Additionally, the actuator module 5 may also include an integrated processor component that may include onboard control logic that controls the actuator module 5 automatically, semi-automatically based partially on a user input or manually based entirely on a user input. The actuator module 5 may also be used to control a Compact Variable Vi Valve (CVVV) as shown in FIGS. 6-10.

Figure 5:
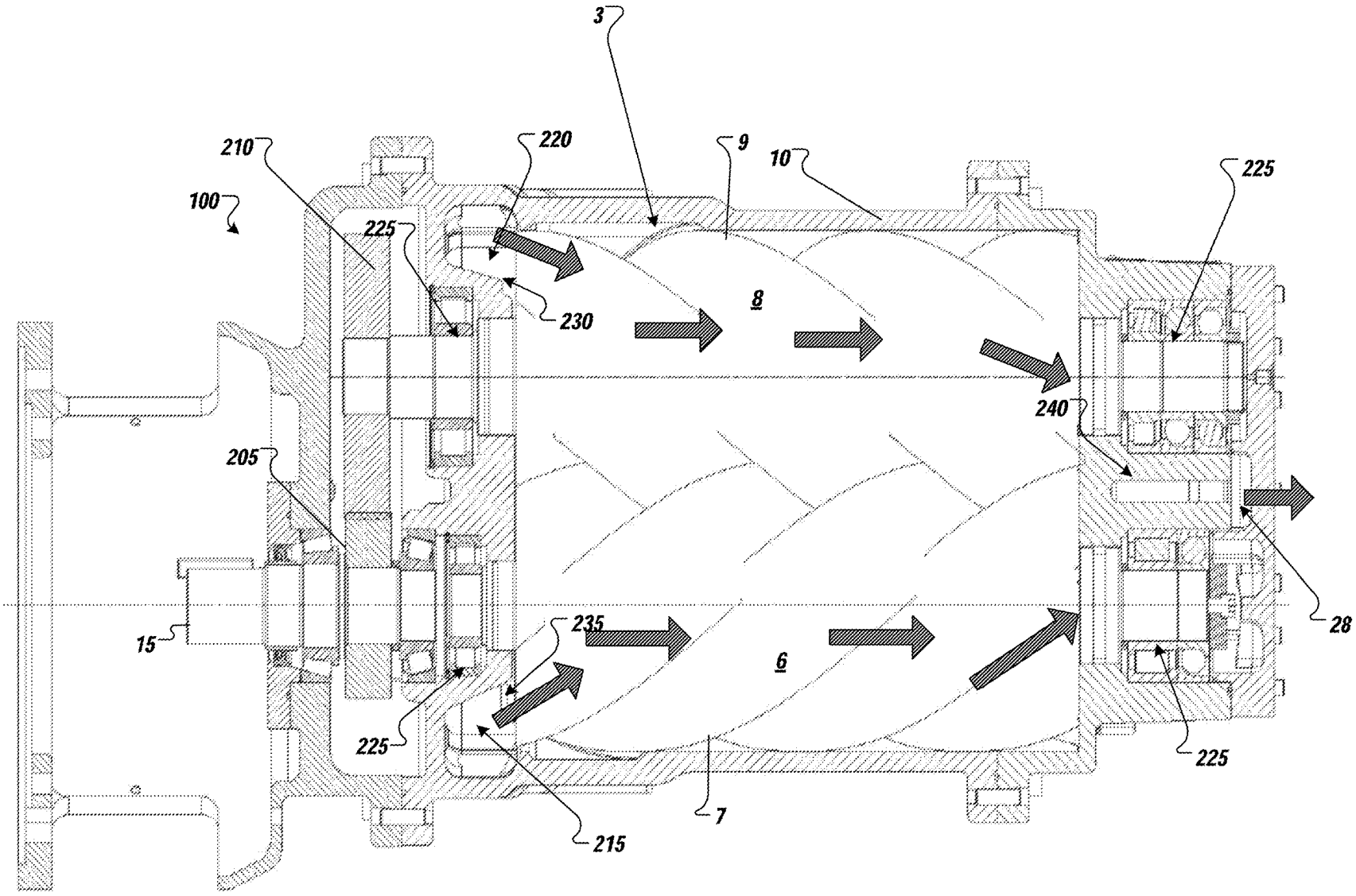
FIG. 5 illustrates a section view of the screw compressor taken along line V-V' of FIG. 3.
Figure 6:
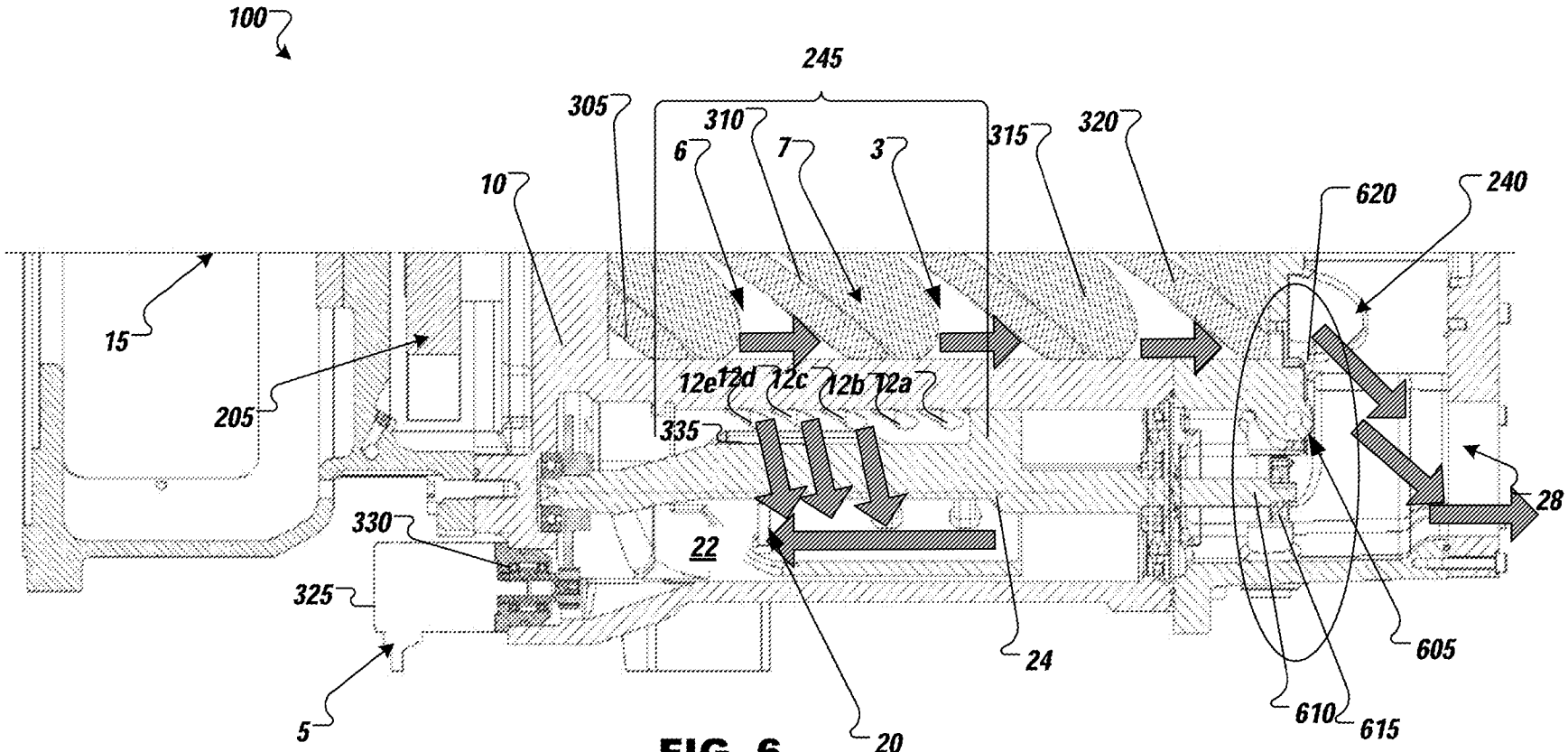
FIG. 6 illustrates a section view of the screw compressor taken along line VI-VI of FIG. 3.
Figure 7:
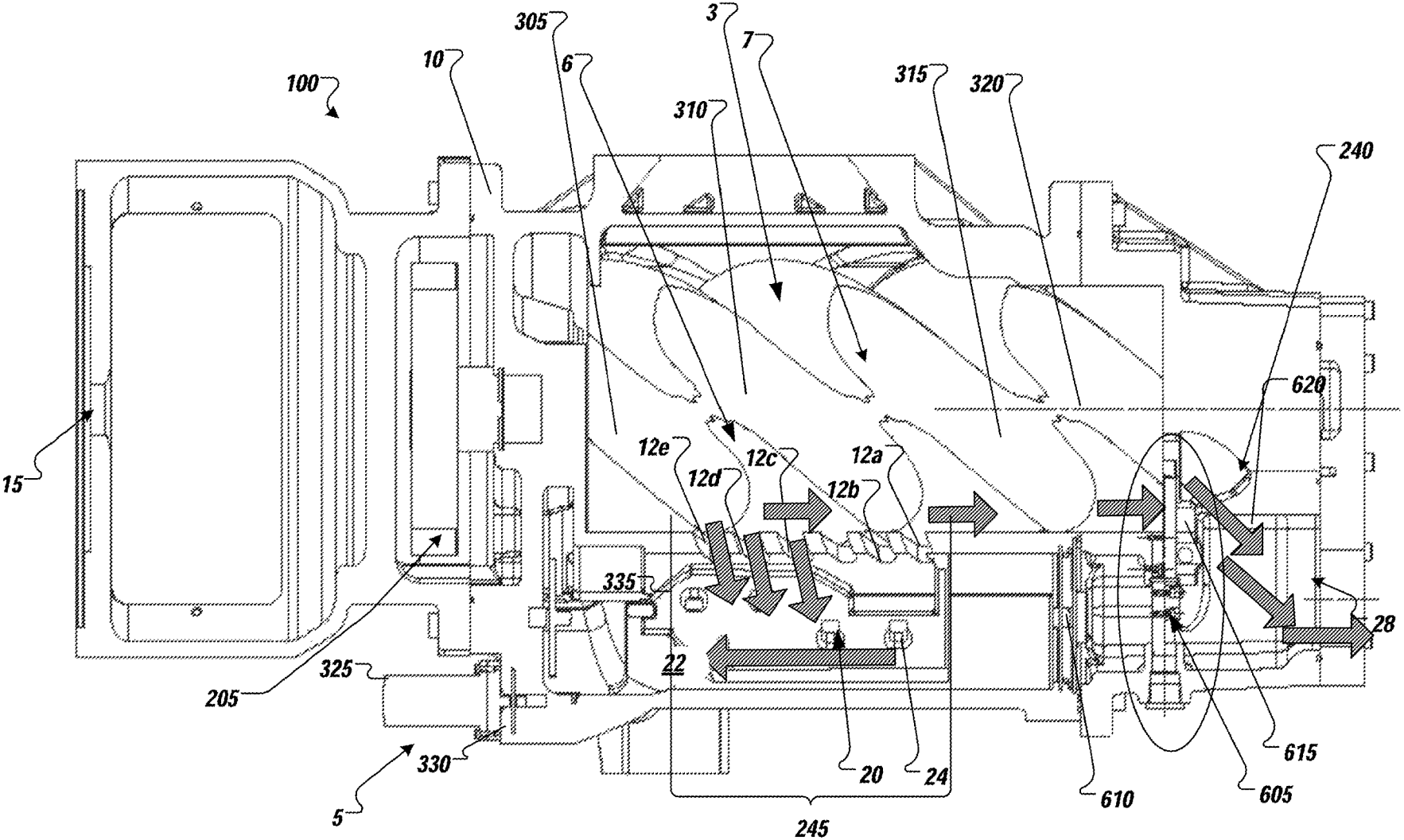
FIG. 7 illustrates a section view of the screw compressor taken along line VII-VII of FIG. 3.
Figure 8:
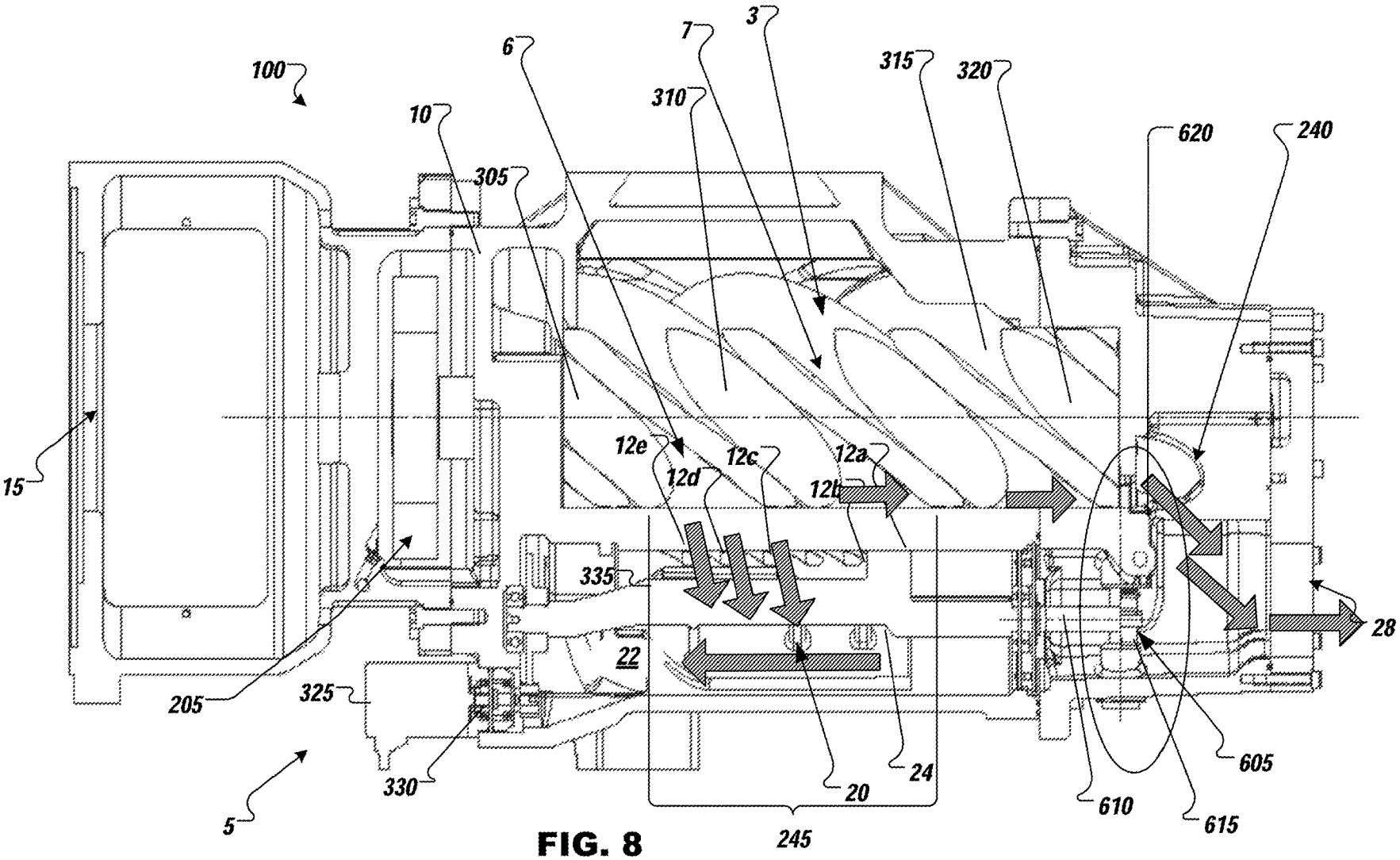
FIG. 8 illustrates a section view of the screw compressor taken along line VIN-VIII of FIG. 4.

FIGS. 5-8 illustrate section views of the screw compressor. Specifically, FIGS. 5-7 illustrates a section view of the screw compressor taken along line V-V', line VI-VI', and line VII-VII' of FIG. 3, respectively. Further, FIG. 8 illustrates a section view of the screw compressor taken along line VI-VIII' of FIG. 4.

The compressor housing 10 forms a compression chamber 3 defining two adjoining bores 6 and 8, each of which includes a screw 7, 9 of the twin screw gas compressor 100, when the unit is assembled and functioning. As illustrated, one of the screws 7 (also known as the drive screw) is mounted on the driven gear 210 and mechanically coupled to shaft 15 by drive gear 205. The motor or engine that drives the screw gas compressor is coupled to shaft 15. The other screw 7 (also known as the driven screw) is driven by drive screw 9. Both screws 7, 9 may each be supported by a bearing group 225, such as roller bearings or any other type of bearing or bushing that might be apparent to a person of ordinary skill in the art.

Further, in some example implementations, one of the screws may have a female lobe configuration, and the other of the screws may have a male lobe configuration. In other words, one of the screws may be a female compressor screw and the other screw may be a male compressor screw that interfaces with the female compressor screw. For example, the drive screw 9 may be a male compression screw and the driven screw 7 may be a female compression screw. As may be apparent to a person of ordinary skill in the art, example implementations of the present application are not limited to this configuration and some example implementations may have an alternative configuration (e.g., the drive screw 9 may be a female compression screw and the driven screw 7 may be a male compression screw).

The end of the compressor housing 10 includes an outlet 28 that fluidly communicates with the inlet 26 (shown in FIGS. 1-4). Gas flow channels 215, 220 may connect each bore 6, 8 with the inlet 26 to allow gas to flow into each bore 6, 8. Each bore 6 and 8 also comprises one or more bypass ports collectively represented by numerals 12*a*-12*e*. The illustrated bypass ports 12*a*-12*e* are formed in bore 6 associated with the driven screw 7. Further, similar bypass ports are formed in bore 8 associated with the drive screw 9, but are not illustrated herein. As shown, each bypass port 12*a*-12*e* fluidly communicates with a bypass chamber 22 that contains a spiral valve 20 that is rotatable along an axis 24. The length of each bore 6, 8 associated with the bypass ports 12*a*-12*e* may be referred to as the bypass window 245.

As described above, the compressor housing 10 has a gas inlet 26 and a gas outlet 28. Within the compressor housing, the gas flow channels 215, 220 provide fluid communication between the inlet 26 and the compression chamber 3. As the screws 7 and 9 turn within the respective bores 6, 8 of the compression chamber 3, gas is compressed inside the compression chamber 3. The compression chamber 3 has a length that runs between compression chamber inlets 230, 235 and a compression chamber outlet end 240. The compressed gas is then output through the gas outlet 28. Arrows illustrate gas flow through the compression chamber 3.

As depicted in FIGS. 6-8, the spiral valve 20 includes a shutter 335 that selectively either blocks (close) or opens the bypass ports 12*a*-12*e*, depending on a rotational position of the spiral valve 20. As the spiral valve 20 is turned to a point that allows one or more of the bypass ports 12*a*-12*e* to fluidly communicate with the spiral valve chamber 22, the effective compression volume of the compression chamber 3 may be reduced due to the shorter compression chamber length.

As shown in FIG. 6, bypass ports 12*c*-12*e* indicate flow and bypass ports 12*a* and 12*b* do not indicate flow. With at least one bypass port 12*c*-12*e* open, the effective compression length of the compression chamber 3 is defined by the distance between the open bypass port closest to compression chamber outlet end 240 and the compression chamber outlet end 240 itself.

When the effective compression volume is reduced in this manner, torque is reduced, which saves power, increases efficiency, and extends the life of the components of the gas compressor. However, as the compression capacity is reduced, adiabatic efficiency may suffer due to power being used to recompress gas flowing back from the system.

The spiral valve 20 is coupled to an actuator module 5 that controls the rotation and position of the shutter 335 of the spiral valve 20. As illustrated, the actuator module 5 includes a motor 325 mechanically coupled to a gearbox 330. The gearbox 330 mechanically couples the motor 325 to the spiral valve 20. Thus, a torque from the motor may be transmitted to the shutter 335 of the spiral valve 20 by the gearbox 330 causing the shutter 335 to rotate. The motor 325 may be an electric actuator motor that provides precise control of rotational speed and rotational position of the spiral valve.

The actuator module 5 may be attached to the compressor housing 10 to control the spiral valve structure located within the compressor housing 10. Additionally, the actuator module 5 may also include an integrated processor component that may include onboard control logic that controls the motor 325 module automatically, semi-automatically based partially on a user input or manually based entirely on a user input.

The spiral valve 20 may be rotated (or actuated) along its axis 24 from a fully open position (where all of the bypass ports are open) to a fully closed position (where all of the bypass ports are closed), and all points in between. In FIGS. 6-8, flow is indicated as if the spiral valve 20 was rotated to a point that allowed for a partial bypass of gas from the compression chamber 3 to the bypass chambers 215, 220. Specifically, bypass ports 12*c*-12*e* allow gas to flow from the compression chamber 3 to the bypass chambers 215, 220. Gas Now is represented by arrows.

Additionally, example implementations of the present disclosure also include a Compact Variable Vi Valve 605 (CVVV), which has been highlighted with an oval in FIGS. 6-8. The CVVV 605 includes valve member 620 mechanically coupled to a toothed gear 615 that is coupled to a rotation shaft 610 extending from the shutter 335 of the spiral valve 20. The CVVV 605 is discussed in greater detail below.

Figure 2:
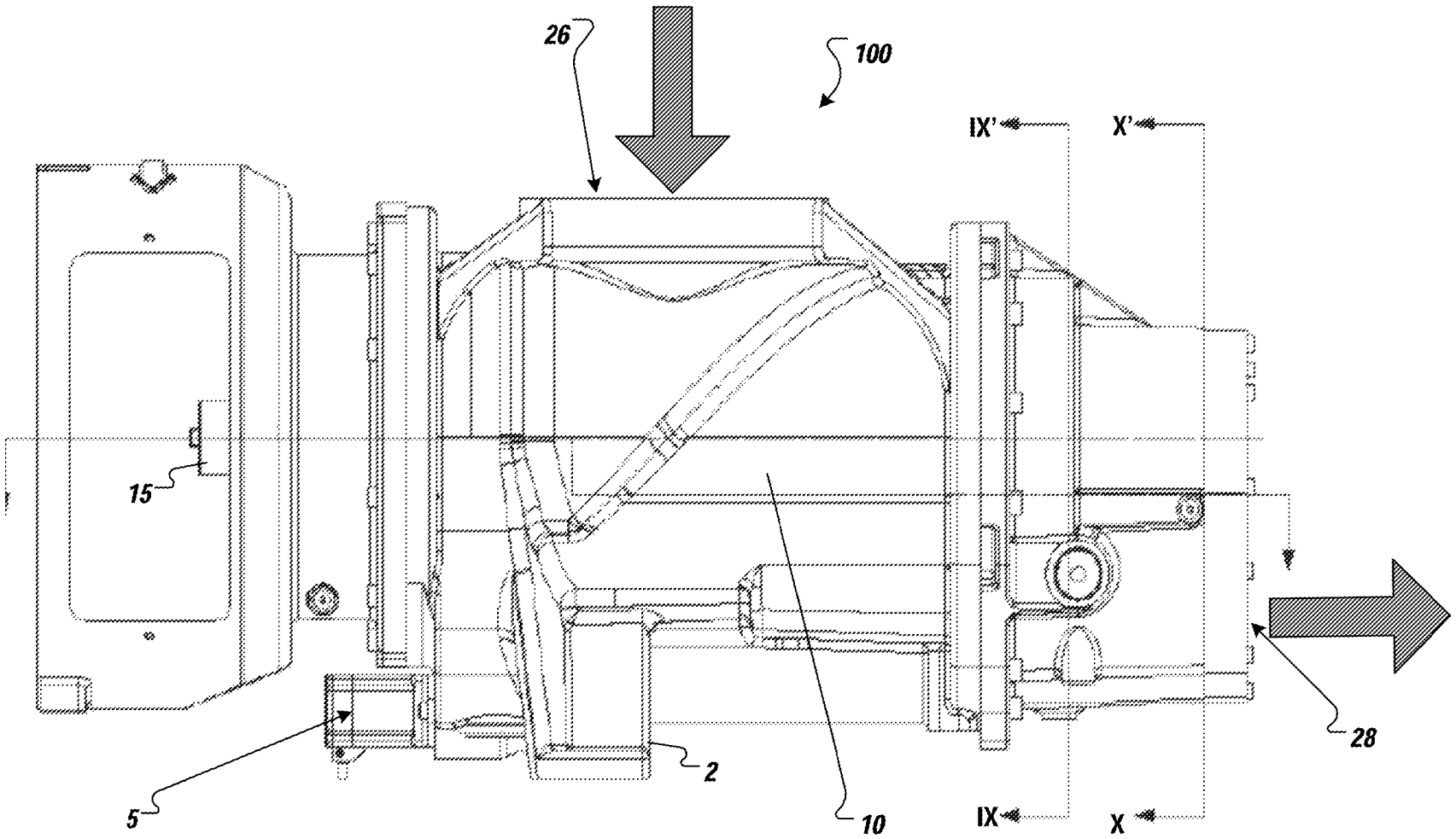
FIG. 2 illustrates a side view of the screw compressor in accordance with the example implementations of the present disclosure shown in FIG. 1.
Figure 3:
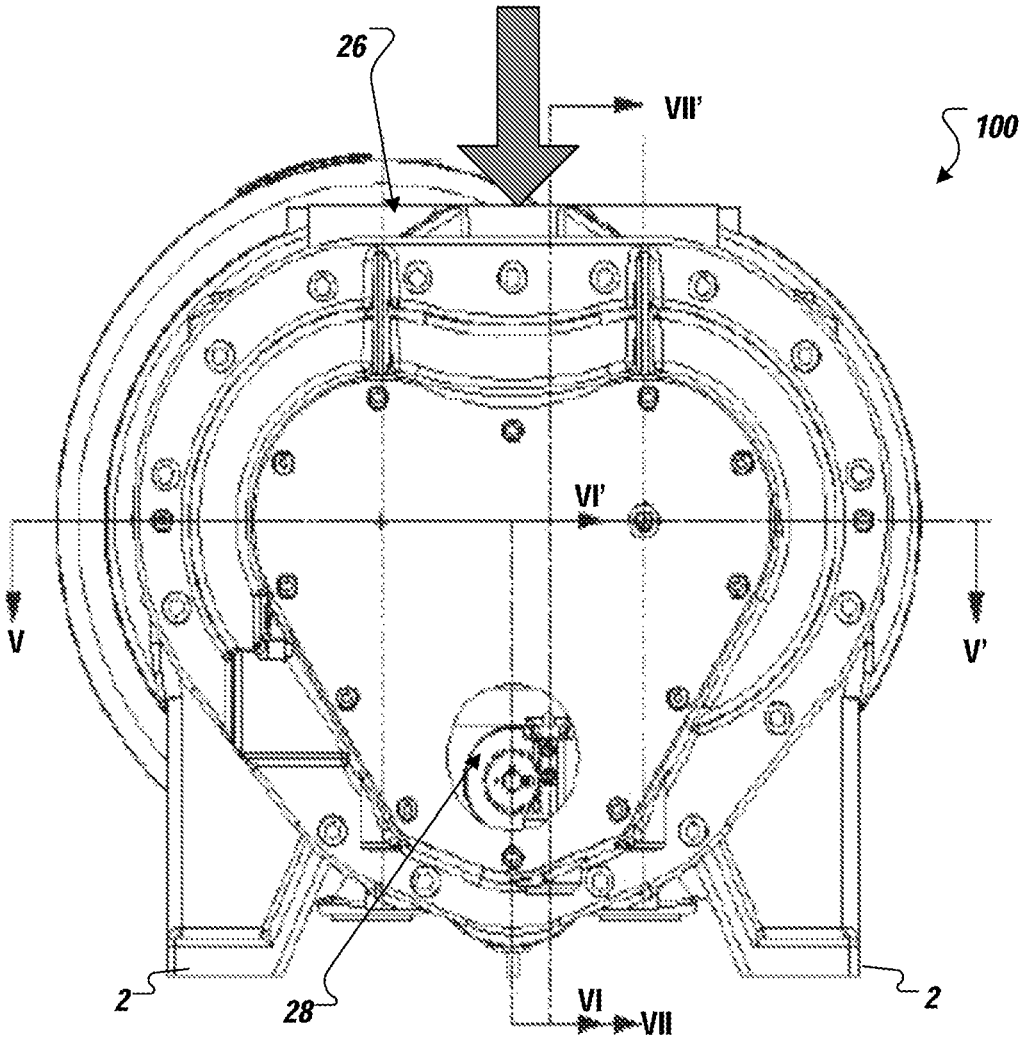
FIG. 3 illustrates an end view of the screw compressor in accordance with the example implementations of the present disclosure shown in FIG. 1.
Figure 4:
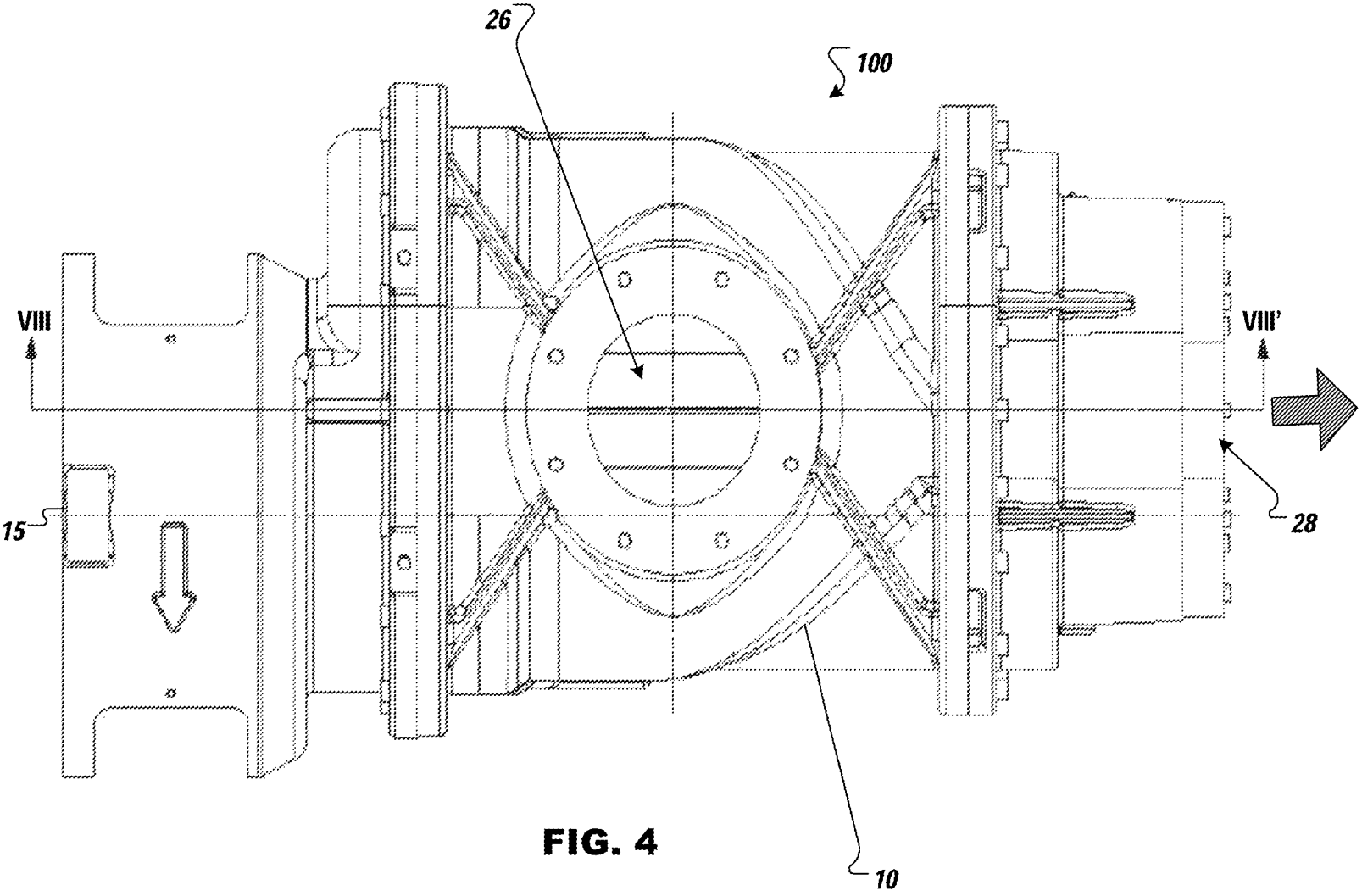
FIG. 4 illustrates a top view of the screw compressor in accordance with the example implementations of the present disclosure shown in FIG. 1.
Figure 9:
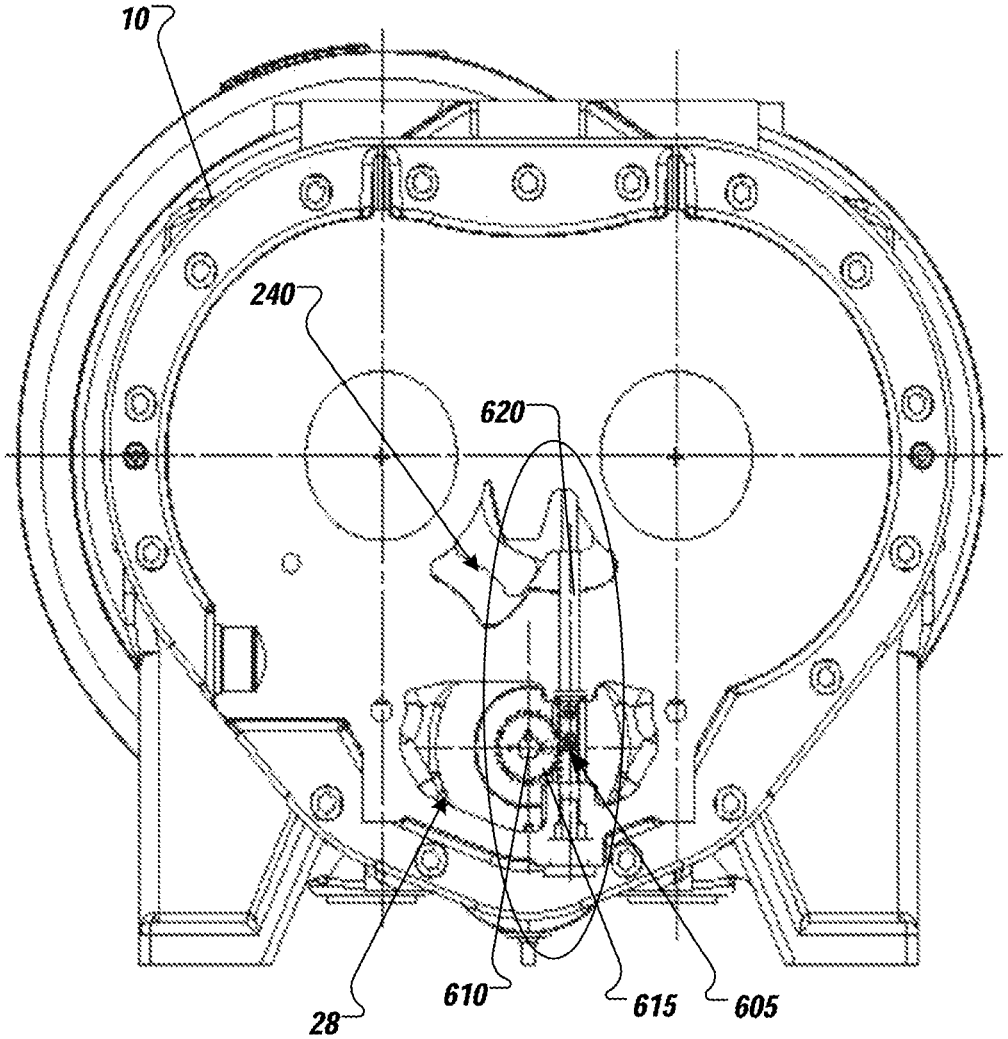
FIG. 9 illustrates a section view of the screw compressor taken along line IX-IX' of FIG. 2.
Figure 10:
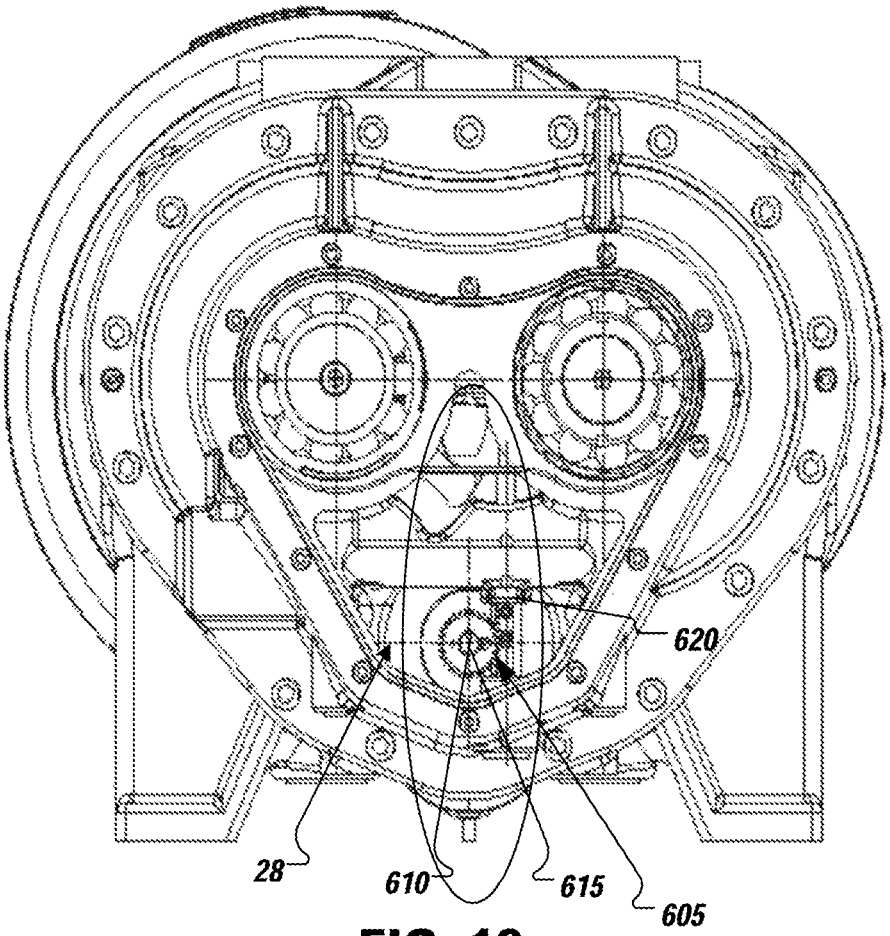
FIG. 10 illustrates a section view of the screw compressor taken along line X-X' of FIG. 2.
Figure 11:
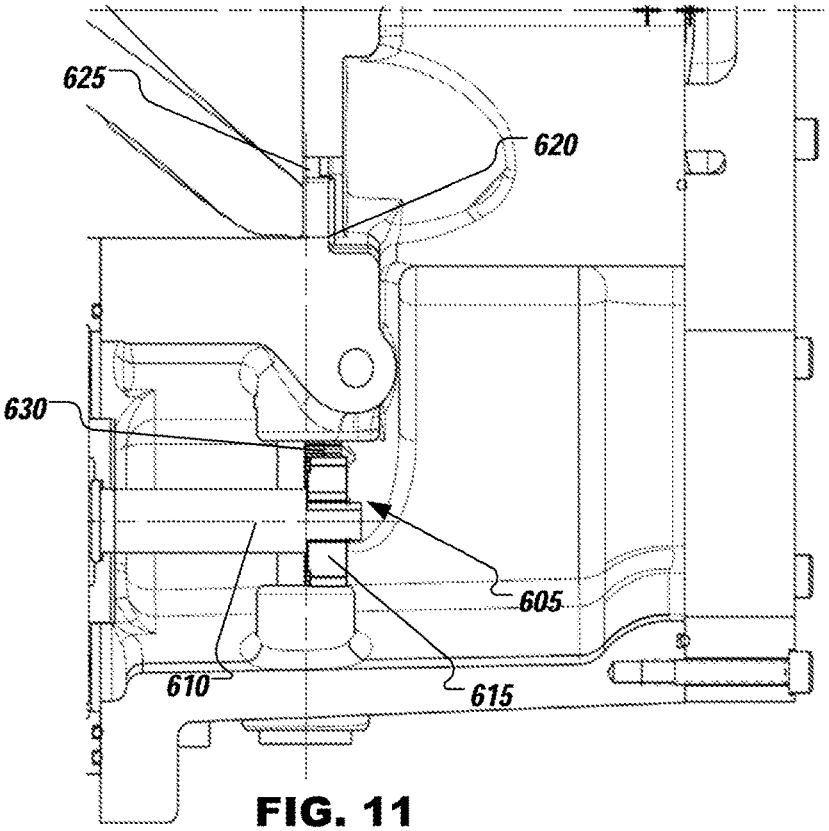
FIG. 11 illustrates an enlarged view of the compact variable Vi Valve shown in FIG. 8.
Figure 12:
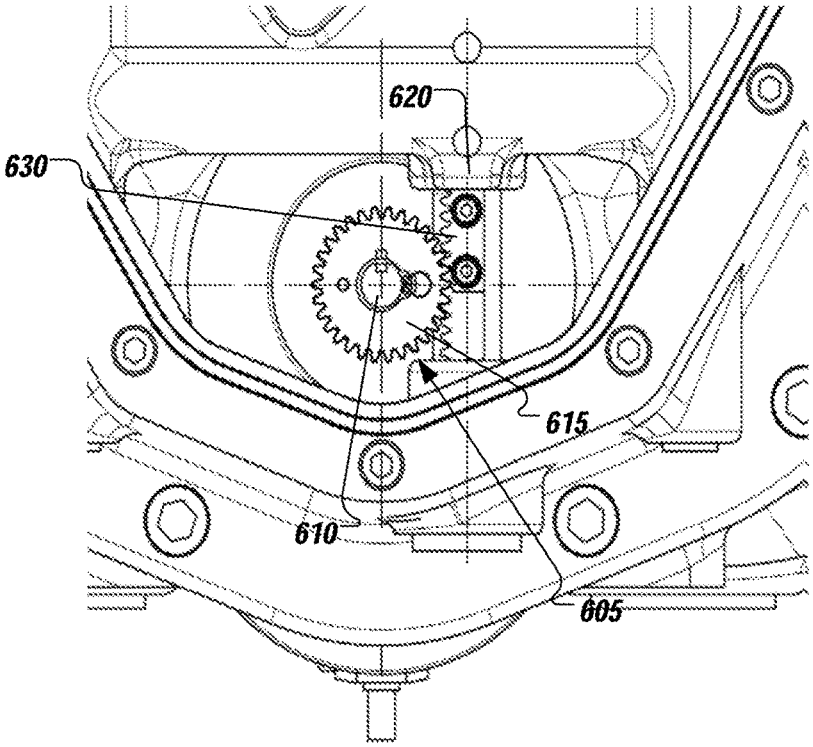
FIG. 12 illustrates an enlarged view of the compact variable Vi Valve shown in FIG. 10.

FIGS. 9 and 10 illustrate section views of the screw compressor taken along lines IX-IX' and X-X' of FIG. 2. The section views of FIGS. 9 and 10 provide an end view of the screw compressor showing the main gas flow outlet 28 and the compression chamber outlet end 240. FIGS. 9 and 10 also illustrate the Compact Variable Vi Valve (CVVV) 605. Further, enlarged views of the CVVV 605 are shown in FIGS. 11 and 12.

As discussed above, the CVVV 605 includes valve member 620 mechanically coupled to a toothed gear 615 that is coupled to a rotation shaft 610 extending from the shutter of the spiral valve. In some example implementations, the valve member 620 is a linear member extending vertically upward into the compression chamber 3 adjacent to the compression chamber outlet end 240. Further, when extended, the valve member 620 may extend radially across the face of compression chamber outlet end to change a radially location that gas exits the compression chamber 3. The valve member 620 may have a cylindrical or semi-cylindrical shape. For example, the valve member 620 may have a half-circle shaped cross-section. Further, the valve member 620 may be positioned or inserted in a radial bore 625 formed in the compressor housing 10 such that the valve member 620 is offset toward the compression chamber outlet end 240 from a centerline of the bore 625. By being offset in the bore 625, a good sealing operation against the compression chamber outlet end 240 may be achieved.

For example, The valve member 620 may take advantage of the inherent sealing properties of a smaller cylinder that can slide inside a slightly larger cylindrical bore that is open for a portion of its circumference on opposite sides so two sealing surfaces on each side of the cylinders are formed. Pressure pushing in either direction seals the smaller cylinder against the larger cylindrical bore and seals the passage and stops the flow around the valve. Further, the valve member 620 centerline is offset far enough away from the discharge face so that there is a sealing surface against pressure from either direction. Thus, the valve member 620 seal is included below the desired flow path to stop any flow in that direction. Thus, the valve member 620 may form a seal designed so that it allows a slight amount of radial cylinder movement so that it can produce its radial sealing characteristics while still sealing axially.

The valve member 620 is flat on one side to allow it to be positioned in the discharge face while not creating a void in the discharge face that would reduce compressor efficiency. Because the valve member 620 is partially in the rotor bore, a valve plug material may be used to fill any void in the surface of the rotor bore that would cause gas leakage past the rotor apex to a lower pressure thread. The valve plug material may also be used to maintain the valve orientation so is does not interfere with rotor movement. The cavity around the actuation side of the valve could be sealed or open to discharge pressure. If open to discharge pressure it would make it easier to manufacture and assemble.

In some example implementations, the valve member 620 may have an actuator structure including a toothed region 630 that engages the toothed gear 615 to move linearly upward based on the rotation of the toothed gear 615. As the toothed gear 615 is coupled to the shaft 610 extending from the shutter 335 of the spiral valve 20. This arrangement may allow the position of the valve member 620 to be controlled by the actuator module 5, which controls rotation of the shutter 335. Further, the position of the valve member 620 may be coordinated to the shutter 335 such that the valve member 620 is optimally positioned for each orientation of the shutter 335 that controls the length of the compression chamber 3.

Example implementations of the CVVV 605 are not limited to an actuator structure for the valve member having a toothed region 630 engaging a toothed gear 615 coupled to the shutter 335 of the spiral valve 20. In other example implementations, the CVVV 605 may include an actuator structure featuring a linear actuator such as a hydraulic cylinder, pneumatic piston, or stepper motor coupled to the shutter 335.

In some example implementations, the CVVV 605 could be implemented with one valve member or two valve members. For example, one valve member may be positioned on the male side of the compression chamber outlet end 240 and one valve member may be position on the female side of the compression chamber outlet end 240. However, only one valve member on one side is necessary if the valve member 620 used is large enough to allow the desired flow. The single valve configuration may be acceptable because the lobes 305/310/315/320 of the male and female screws mesh and are connected to the same compression chamber.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed. Moreover, example implementations are not limited to industrial or fixed location; portable configurations may be achieved by mounting the screw compressor 100 on a vehicle, trailer or other portable structure.

The foregoing detailed description has set forth various example implementations of the devices and/or processes via the use of diagrams, schematics, and examples. Insofar as such diagrams, schematics, and examples contain one or more functions and/or operations, each function and/or operation within such diagrams or examples can be implemented, individually and/or collectively, by a wide range of structures. While certain example implementations have been described, these implementations have been presented by way of example only and are not intended to limit the scope of the protection. Indeed, the novel methods and apparatuses described herein may be embodied in a variety of other forms. Furthermore, various omissions, substitutions and changes in the form of the devices and systems described herein may be made without departing from the spirit of the protection. The accompanying claims and their equivalents are intended to cover such forms or modifications as would fall within the scope and spirit of the protection.

What is claimed:

1. A Compact Variable Volume Index Valve for a screw compressor having a compressor housing defining a compression chamber, the compact variable volume index valve comprising:

a linear valve member positioned adjacent a compression chamber outlet end of the compression chamber; and an actuator structure coupled to the linear valve member and oriented to move the linear valve member radially along the compression chamber outlet end of the compression chamber to adjust a radial location where gas exits the compression chamber, wherein the actuator structure is coupled to a shutter of a spiral valve of the screw compressor such that the actuator structure moves the linear valve member based on a position of the spiral valve of the screw compressor.

2. The Compact Variable Volume Index Valve of claim 1, wherein the actuator structure comprises:

a toothed region provided on the linear valve member; and a toothed gear engaging the toothed region of the linear valve member, wherein the toothed gear is coupled to a shaft extending from the shutter of the spiral valve.

3. The Compact Variable Volume Index Valve of claim 1, wherein the linear valve member has a semi-cylindrical shape.

4. The Compact Variable Volume Index Valve of claim 1, wherein the linear valve member is inserted into a radial bore formed in the compressor housing.

5. The Compact Variable Volume Index Valve of claim 4, wherein the linear valve member is inserted into the radial bore such that the linear valve member is offset toward the compression chamber outlet end from a centerline of the radial bore.

6. A screw compressor comprising:

a compressor housing defining a compression chamber having a compression chamber outlet end and a plurality of bypass ports communicating with the compression chamber;

a spiral valve positioned adjacent the plurality of bypass ports communicating with the compression chamber, the spiral valve comprising a shutter configured to selective open and close one or more of the plurality of bypass ports based on a rotational position; and a compact variable volume index valve comprising:

a linear valve member positioned adjacent the compression chamber outlet end of the compression chamber; and an actuator structure coupled to the linear valve member and oriented to move the linear valve member radially along the compression chamber outlet end of the compression chamber to adjust a radial location where gas exits the compression chamber, wherein the actuator structure is coupled to the shutter of the spiral valve of the screw compressor such that the actuator structure moves the linear valve member based on a position of the spiral valve of the screw compressor.

7. The screw compressor of claim 6, wherein the actuator structure comprises:

a toothed region provided on the linear valve member; and a toothed gear engaging the toothed region of the linear valve member, wherein the toothed gear is coupled to a shaft extending from the shutter of the spiral valve.

8. The screw compressor of claim 6, wherein the linear valve member has a semi-cylindrical shape.

9. The screw compressor of claim 6, wherein the linear valve member is inserted into a radial bore formed in the compressor housing.

10. The screw compressor of claim 9; wherein the linear valve member is inserted into the radial bore such that the linear valve member is offset toward the compression chamber outlet end front a centerline of the radial bore.

* * * * *